US010316840B2

(12) United States Patent
Patterson et al.

(10) Patent No.: US 10,316,840 B2
(45) Date of Patent: Jun. 11, 2019

(54) ROTARY DEVICE HAVING A CIRCULAR GUIDE RING

(71) Applicant: WindTrans Systems Ltd, Seaforth (CA)

(72) Inventors: Dan Patterson, Seaforth (CA); Andrew Masse, Seaforth (CA)

(73) Assignee: WindTrans Systems Ltd, Seaforth (CA)

( * ) Notice: Subject to any disclaimer, the term of this patent is extended or adjusted under 35 U.S.C. 154(b) by 132 days.

(21) Appl. No.: 15/348,271

(22) Filed: Nov. 10, 2016

(65) Prior Publication Data

US 2018/0058448 A1 Mar. 1, 2018

Related U.S. Application Data

(60) Provisional application No. 62/380,837, filed on Aug. 29, 2016.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/344*** | (2006.01) |
| ***F01C 1/344*** | (2006.01) |
| ***F01C 21/08*** | (2006.01) |

(Continued)

(52) U.S. Cl.

CPC ..... *F04C 2/344* (2013.01); *F01C 1/344* (2013.01); *F01C 21/0809* (2013.01); *F01C 21/10* (2013.01); *F04C 15/0003* (2013.01)

(58) Field of Classification Search

CPC .. F01C 1/344; F01C 21/0809; F01C 21/0836; F01C 21/10; F01C 21/106; F01C 21/108; F04C 15/0003; F04C 2/344

USPC ..... 418/143, 253, 257, 259, 260–264, 418/266–268

See application file for complete search history.

(56) References Cited

U.S. PATENT DOCUMENTS

| | | | |
|---|---|---|---|
| 502,890 | A | 8/1893 | Reichhelm |
| 1,237,273 | A | 8/1917 | Baade |

(Continued)

FOREIGN PATENT DOCUMENTS

| | | | |
|---|---|---|---|
| CA | 2421188 | A1 | 3/2003 |
| WO | 2014138870 | A1 | 9/2014 |

OTHER PUBLICATIONS

Office Action for U.S. Appl. No. 13/710,331 dated Dec. 9, 2014.

(Continued)

*Primary Examiner* — Theresa Trieu

(74) *Attorney, Agent, or Firm* — Honigman LLP

(57) ABSTRACT

A rotary device for use with a fluid includes a housing, a rotor, a ring, and at least one vane. The housing includes a tubular surface defining, in part, a tubular volume. The housing is segregated into at least a pumping zone positioned between first and second working zones. The first working zone is configured to receive a fluid and the second working zone is configured to output the fluid. The rotor is mounted for rotation about a rotation axis. The rotor includes a body mounted within the tubular volume. The body includes a plurality of slots. The ring is at least indirectly coupled to the housing by way of a bearing. The at least one vane is associated with one slot of the plurality of slots. The at least one vane is connected at least indirectly to the ring and configured to rotate within the tubular volume.

13 Claims, 15 Drawing Sheets

(51) Int. Cl.
*F01C 21/10* (2006.01)
*F04C 15/00* (2006.01)

(56) References Cited

U.S. PATENT DOCUMENTS 2,117,573 A 5/1938 Rawls
2,312,961 A 3/1943 Cowherd
2,815,647 A 12/1957 Albrecht et al.
3,439,623 A 4/1969 Dietrich et al.
3,612,733 A 10/1971 Wilcox
3,717,423 A 2/1973 Pedersen et al.
3,985,479 A 10/1976 Sommer et al.
4,073,608 A 2/1978 Christy
4,397,621 A 8/1983 Pickard et al.
4,418,663 A 12/1983 Bentley
4,605,361 A 8/1986 Cordray
4,955,985 A * 9/1990 Sakamaki ..... F01C 21/0809 418/265
5,171,131 A 12/1992 Niemiec
5,242,285 A 9/1993 Westermann, Jr.
5,378,111 A 1/1995 Christopher
5,634,783 A 6/1997 Beal
5,899,677 A 5/1999 Ono et al.
6,659,067 B1 * 12/2003 Al-Hawaj ..... F01C 1/3446 418/260
6,821,093 B2 11/2004 Zagranski et al.
7,118,361 B2 10/2006 Patterson
7,229,262 B2 6/2007 Patterson
7,255,546 B1 8/2007 Del Rio
7,637,724 B2 12/2009 Cygnor
9,297,379 B2 3/2016 Patterson et al.
9,441,626 B2 9/2016 Patterson et al.
2008/0240935 A1 10/2008 Dong
2009/0169409 A1 * 7/2009 Schneider ..... F04C 2/3445 418/259
2011/0311387 A1 12/2011 Schultz
2013/0202468 A1 * 8/2013 Patterson ..... F01C 21/0836 418/143
2013/0202472 A1 * 8/2013 Patterson ..... F04C 2/344 418/143
2015/0078946 A1 3/2015 Geue et al.

OTHER PUBLICATIONS

Office Action for U.S. Appl. No. 13/710,331 dated Mar. 24, 2015.
Office Action for U.S. Appl. No. 13/710,331 dated Nov. 23, 2015.
Office Action for U.S. Appl. No. 13/830,242 dated Aug. 7, 2014.
Office Action for U.S. Appl. No. 13/830,242 dated Mar. 24, 2015.
Office Action for U.S. Appl. No. 13/830,242 dated Sep. 24, 2015.
Office Action for U.S. Appl. No. 13/830,242 dated Apr. 14, 2016.
International Search Report for PCT/CA2014/000192 dated Jul. 7, 2014.
Office Action for U.S. Appl. No. 13/710,331 dated Aug. 7, 2015.
International Search Report for PCT/IB2017/001178 dated Jan. 30, 2018.

* cited by examiner

ROTARY DEVICE HAVING A CIRCULAR GUIDE RING

CROSS REFERENCE TO RELATED APPLICATIONS

This U.S. patent application claims priority under 35 U.S.C. § 119(e) to U.S. Provisional Application 62/380,837, filed on Aug. 29, 2016. The disclosure of the prior application is considered part of the disclosure of this application and is hereby incorporated by reference in its entirety.

TECHNICAL FIELD

The present disclosure relates generally to a rotary device, and more particularly to a rotary device having a circular guide ring.

BACKGROUND

This section provides background information related to the present disclosure and is not necessarily prior art.

A rotary device, such as a vane pump, often includes vanes mounted to a rotor that rotates inside a cavity. The vanes can be of variable length and/or tensioned to maintain contact with the cavity wall as the pump rotates. While known rotary devices have proven acceptable for their intended purpose, a continuous need for improvement in the relevant art remains.

SUMMARY

This section provides a general summary of the disclosure, and is not a comprehensive disclosure of its full scope or all of its features.

One aspect of the disclosure provides a rotary device for use with a fluid. The rotary device may include a housing, a rotor, a ring, and at least one vane. The housing may include a tubular surface defining, in part, a tubular volume. The housing may be segregated into at least a pumping zone positioned between first and second working zones. The first working zone may be configured to receive a fluid and the second working zone may be configured to output the fluid. The rotor may be mounted for rotation about a rotation axis. The rotor may include a body mounted within the tubular volume. The body may include a plurality of slots. The ring may be at least indirectly coupled to the housing by way of a bearing. The at least one vane may be associated with one slot of the plurality of slots. The at least one vane may be connected at least indirectly to the ring and configured to rotate within the tubular volume.

In some implementations, the rotary device includes a bearing coupled to the housing and positioned to support the ring. The bearing may be configured to rotate about a bearing axis and maintain a position of the ring with respect to the housing as the ring rotates. The ring may include an outer surface in contact with an outer surface of the bearing. In some implementations, the outer surface of the ring may include a concave shape. The outer surface of the bearing may include a convex shape complimentary to the concave shape of the ring. In some implementations, the outer surface of the ring has a convex shape. The outer surface of the bearing may include a concave shape complimentary to the convex shape of the ring.

In some implementations, the rotary device includes a track disposed outside the tubular volume. The track may be disposed concentrically about at least a portion of the tubular surface. In some implementations, the ring is sized to fit within the track. The track may define a circular shape.

In some implementations, the tubular volume defines in cross-section a circular shape along the pumping zone and the first and second working zones.

In some implementations, the tubular volume defines in cross-section an ovular shape along the first and second working zones and a circular shape along the pumping zone.

In some implementations, the ring includes a plurality of slots. Each vane may be configured to move within a slot of the plurality of slots.

In some implementations, each slot is separated from an adjacent slot by a distance.

In some implementations, the rotary device may be one of a pump and a hydraulic motor.

In some implementations, the at least one vane includes a first vane, a second vane, and a third vane. A circumferentially-extending distance between the first vane and the second vane may be greater than a circumferentially-extending distance between the second vane and the third vane.

Another aspect of the disclosure provides a method of operating a rotary device. The method may include receiving a fluid in a first working zone of a housing. The housing may include a tubular surface defining, in part, a tubular volume. The method may also include outputting the fluid from a second working zone disposed downstream of the first working zone. The method may further include pumping the fluid through a pumping zone positioned downstream of the first working zone and upstream of the second working zone. The method may also include rotating a rotor about a first axis within the tubular volume. The rotor may include a plurality of slots. Each slot of the plurality of slots may include a vane assembly at least partially disposed therein. The method may further include engaging a portion of the each vane assembly with a ring at least indirectly coupled to the housing to cause the ring to rotate about a second axis radially offset from the first axis.

In some implementations, the method includes engaging the ring with a bearing to cause the bearing to rotate about a third axis radially offset from the first and second axes.

In some implementations, the method includes rotating the vanes relative to the ring. The method may also include translating each vane in a radially extending direction within a slot of the plurality of slots.

In some implementations, the ring includes a plurality of slots. The method may further include translating a portion of each vane within one of the plurality of slots of the ring.

Yet another aspect of the disclosure provides a rotary device for use with a fluid. The rotary device may include a housing, a rotor, a ring, and at least one vane. The housing may include a tubular surface and an end surface. The tubular surface may define a tubular volume and may include a first working portion, a second working portion, and a pumping portion. The pumping portion may extend from the first working portion to the second working portion. The end surface may include a channel defining a circular cam path. The rotor may be disposed within the tubular volume for rotation about a first axis. The rotor may include an outer surface disposed about the first axis. The outer surface may include a plurality of slots. The ring may be disposed within the channel. The ring may be concentric to the cam path and configured to rotate about a second axis radially offset from the first axis. The at least one vane may be associated with one slot of the plurality of slots. The at least one vane may be at least indirectly coupled to the ring for rotation therewith.

In some implementations, the rotary device includes a plurality of bearings disposed within the channel. Each of the plurality of bearings may engage the ring.

The details of one or more implementations of the disclosure are set forth in the accompanying drawings and the description below. Other aspects, features, and advantages will be apparent from the description and drawings, and from the claims.

DESCRIPTION OF DRAWINGS

The drawings described herein are for illustrative purposes only of selected configurations and not all possible implementations, and are not intended to limit the scope of the present disclosure.

Like reference symbols in the various drawings indicate like elements.

DETAILED DESCRIPTION

Figure 1A:
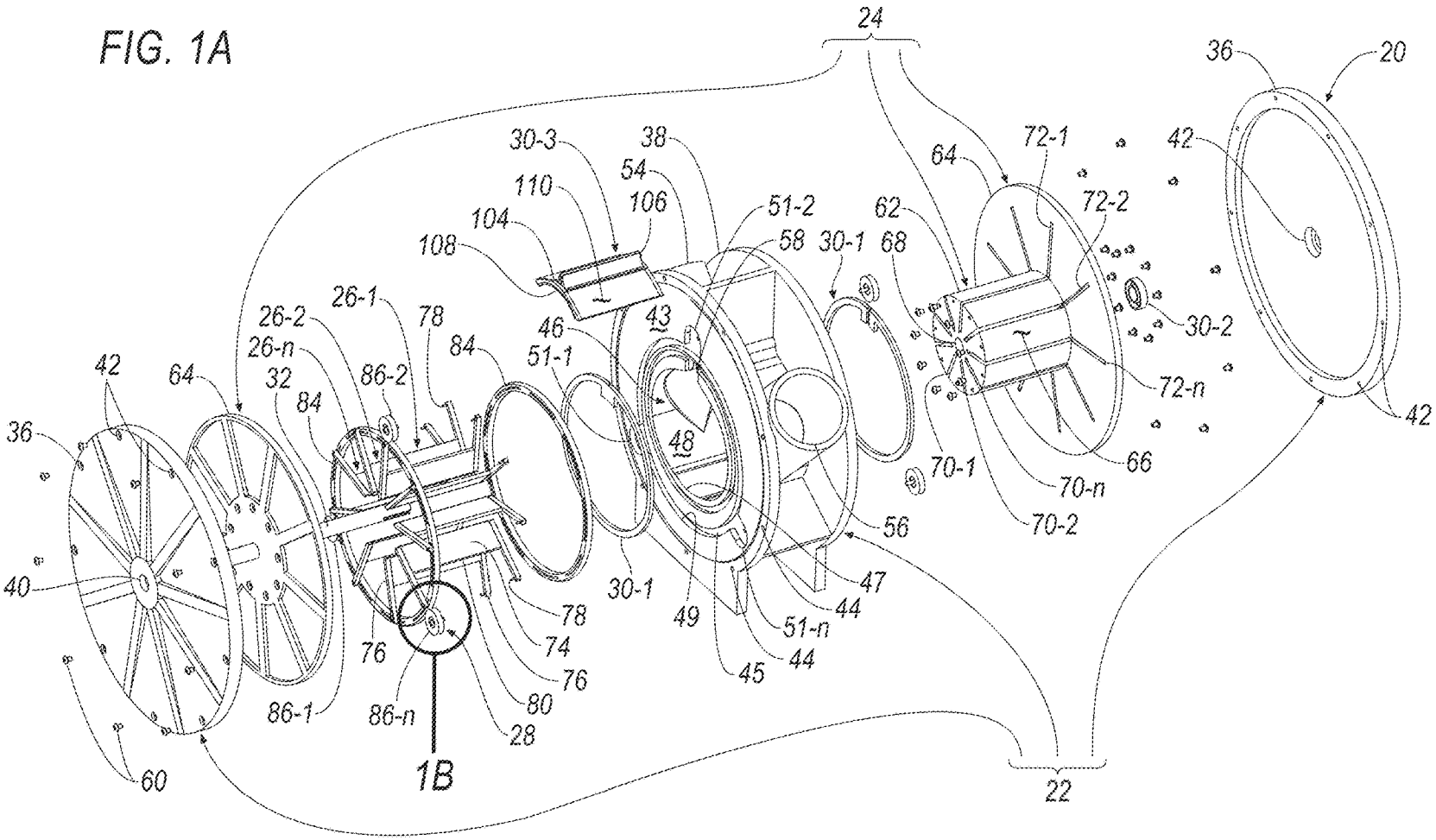
FIG. 1A is an exploded view of a rotary device according to the principles of the present disclosure.

FIG. 1A illustrates an exploded view of a rotary device 20 in accordance with the principles of the present disclosure. While the rotary device 20 is generally shown and described herein as a "pump 20," it will be appreciated that the structure could be utilized with other rotary devices, such as motors (e.g., hydraulic motors), meters, and propulsion devices, in accordance with the principles of the present disclosure.

The pump 20 may include a housing 22, a rotor 24, a plurality of vane assemblies 26-1, 26-2, . . . **26-*n*, a coupler 28, a plurality of seals 30-1, 30-2, . . . 30-*n*, and a driveshaft 32. The rotary pump 20 may be utilized to generate a flow of fluid (e.g., water, fuel, lubricant, etc.) through the housing 22**.

With particular reference to FIG. 1A, the housing 22 may include a pair of end plates 36 and a housing body. Each end plate 36 may define a central aperture 40 and a plurality of through holes 42. The housing body 38 may include a pair of opposed radially extending end surfaces 43. Each surface 43 may include a plurality of apertures 44, a channel 45, and a central aperture 47. In an assembled configuration, each of the through holes 42 of the end plates 36 may be aligned with a corresponding one of the through holes 44 of the housing body 38.

In some implementations, the channel 45 is defined at least in part by an outer surface 49. The outer surface 49 may be referred to herein as the "track 49" or the "cam path 49." In this regard, the outer surface 49 may define a substantially circular shape having a plurality of lobes 51-1, 51-2, . . . **51-*n*. The central aperture 40 may be concentrically disposed within the outer surface 49 and in fluid communication with an interior chamber 46 (e.g., a tubular volume) defined by a tubular surface 48 of the housing body 38. In use, nut (not shown) and/or bolt 60 assemblies may be disposed within the through holes 42, 44 to secure the end plates 36 to the housing body 38. In other implementations, the end plates 36 and the housing body 38** may be secured to each other using other means, such as welding, friction-fit, or other suitable techniques.

Figure 3:
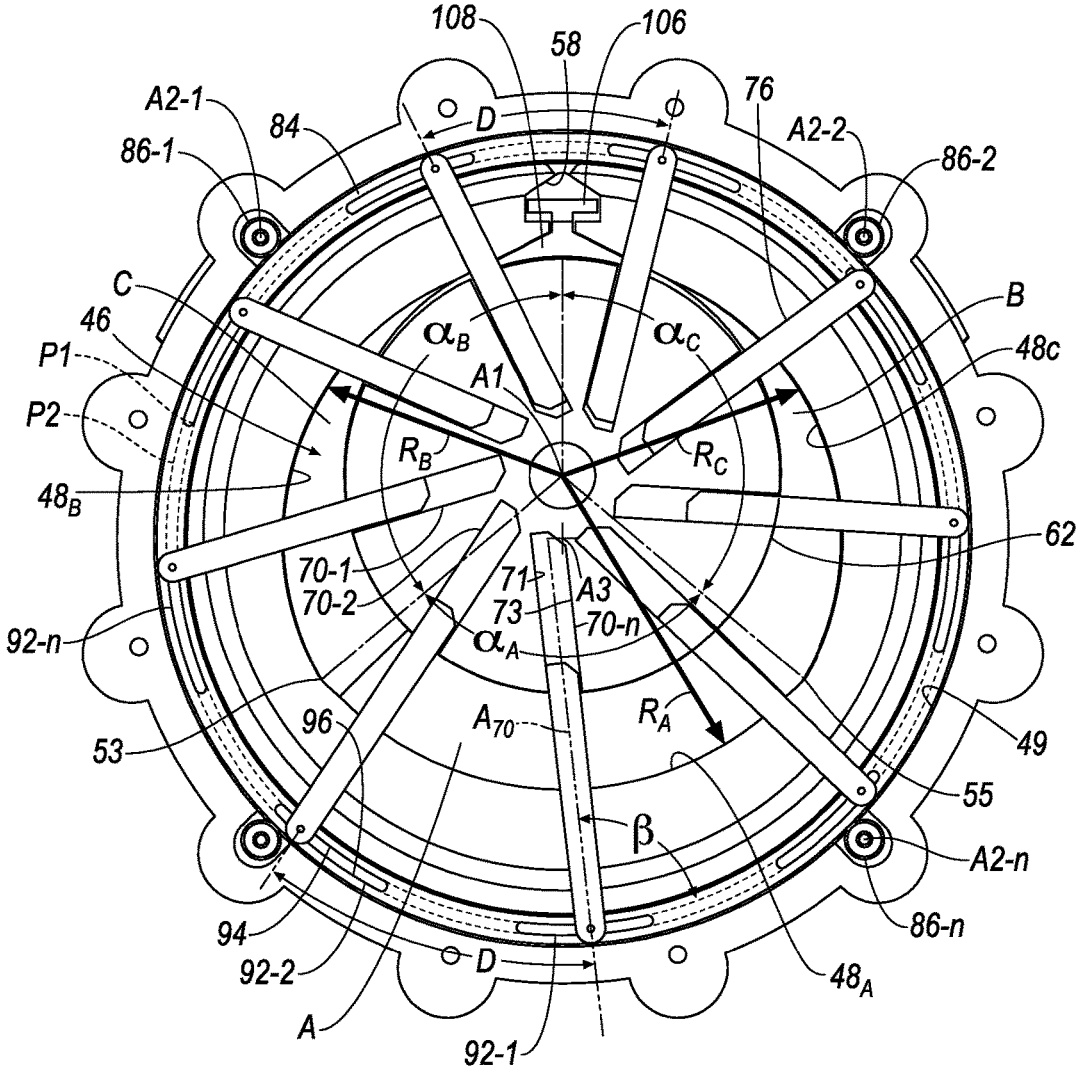
FIG. 3 is a side view of the rotary device of FIG. 1A, a portion of the rotary device being removed for clarity.
Figure 7A:
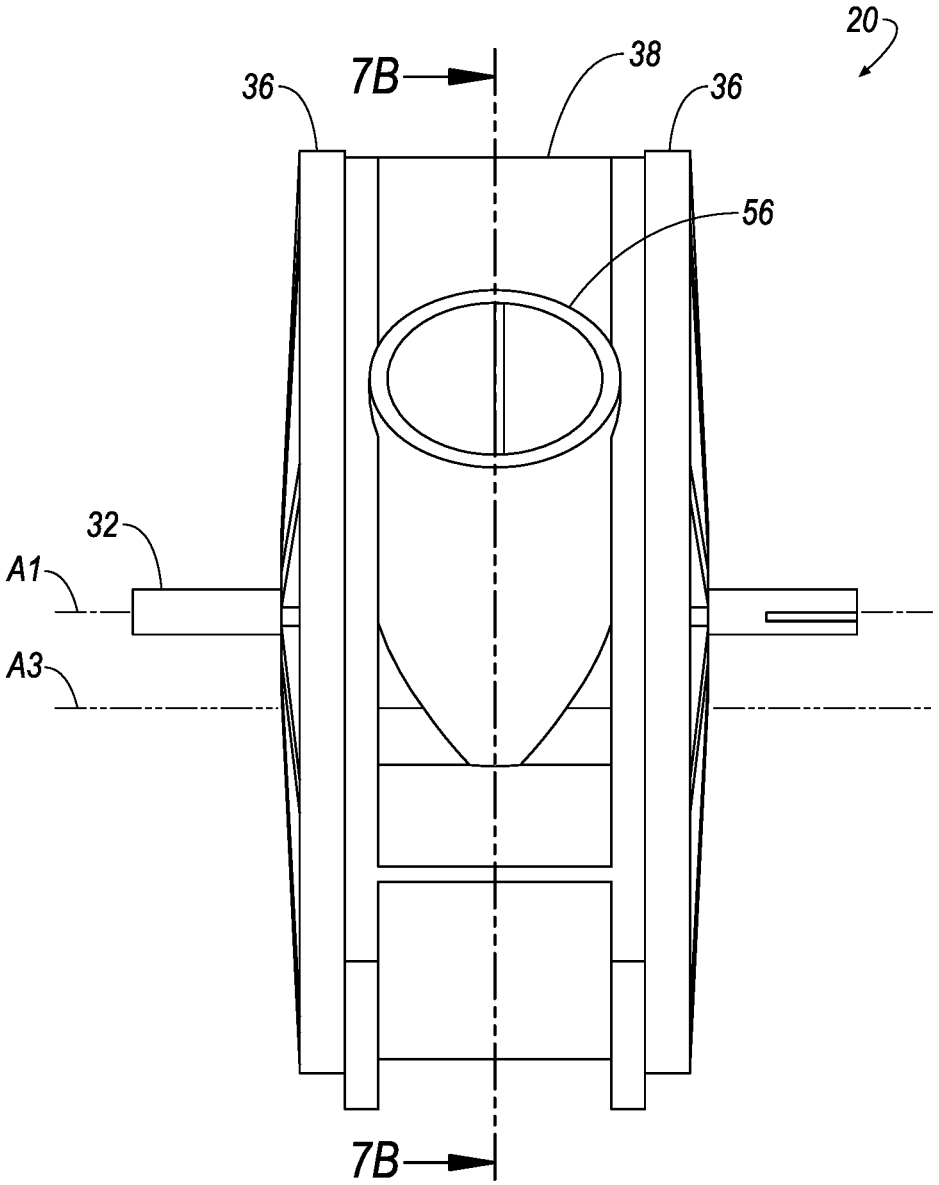
FIG. 7A is a side view of another rotary device according to the principles of the present disclosure.
Figure 7B:
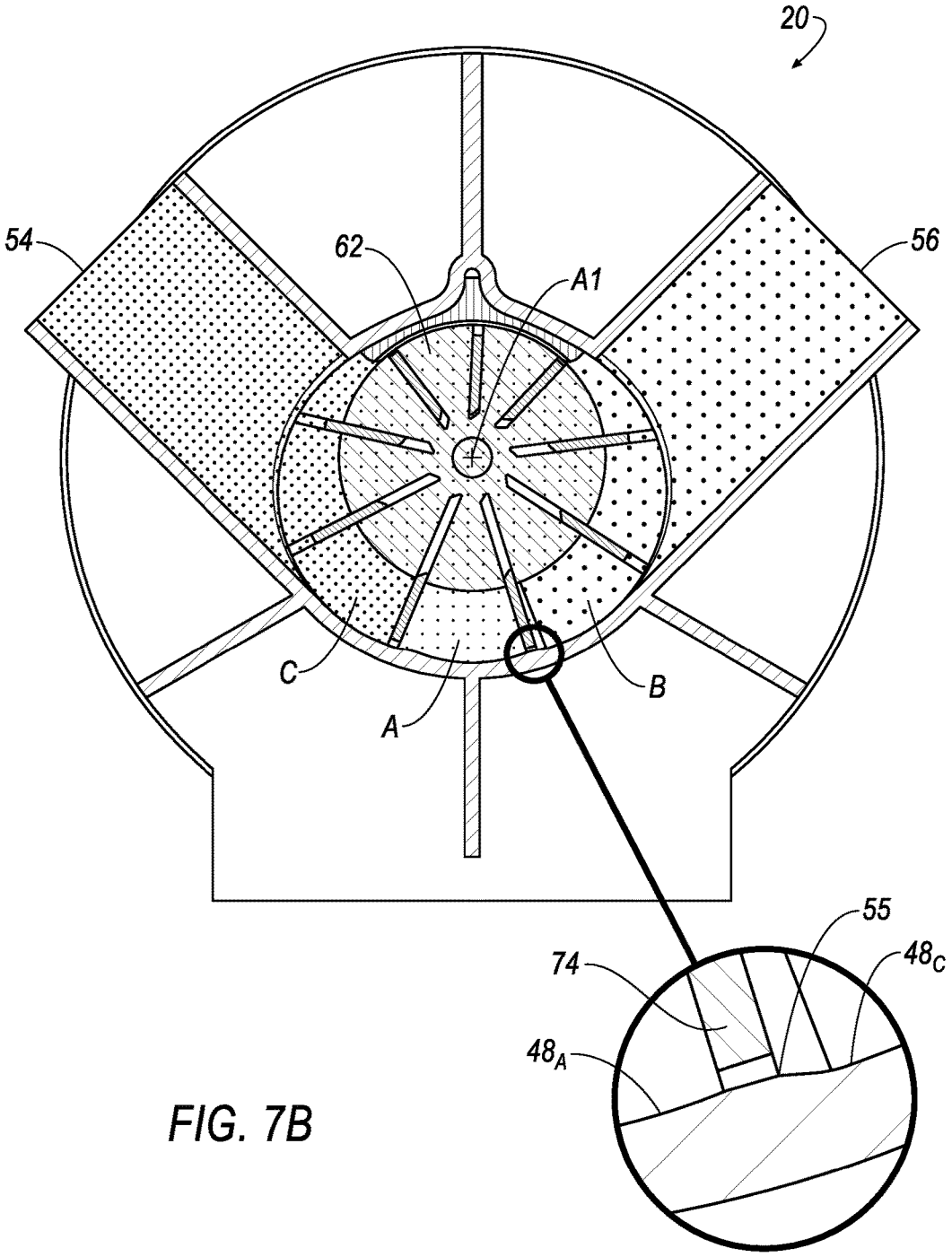
FIG. 7B is a cross-sectional view of the rotary device of FIG. 7A taken along the line D-D, the rotary device shown in a first operational orientation.
Figure 7C:
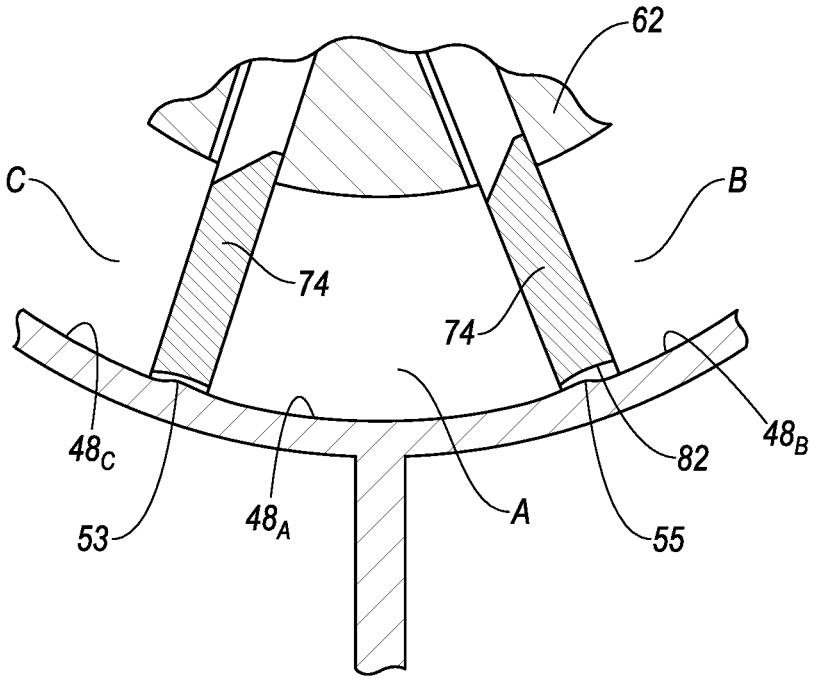
FIG. 7C is a partial cross-sectional view of the rotary device of FIG. 7A taken along the line D-D, the rotary device shown in a second operational orientation.
Figure 7D:
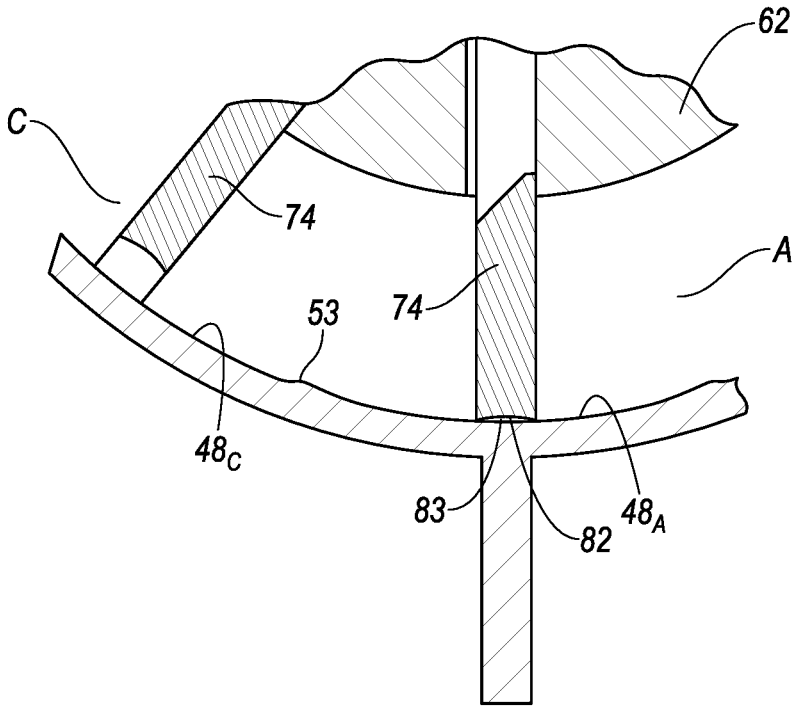
FIG. 7D is a partial cross-sectional view of the rotary device of FIG. 7A taken along the line D-D, the rotary device shown in a third operational orientation.

The tubular surface 48 of the housing body 38 may be circular in cross-section, oblong in cross section, or a combination of both. As illustrated in FIG. 3, for example, in some implementations, the cross section of the tubular surface 48 defines at least one of an oval, an ellipse, and an egg-shape. In some implementations, the tubular surface 48 may be concentrically disposed within the cam path 49. As illustrated in FIG. 3, the tubular surface 48 may define the interior chamber 46 to include a pumping zone A, a first working zone B, and a second working zone C. The pumping zone A is downstream of the first working zone B and upstream of the second working zone. With reference to FIGS. 7B-7D, the pumping zone A may be defined by a pumping portion $\mathbf{48}_A$ of the tubular surface 48. As illustrated in FIG. 3, the pumping portion $\mathbf{48}_A$ of the tubular surface 48 may define a central angle $\alpha_A$ and a radius $R_A$ relative to a central axis A1 of the chamber 46. In some implementations, the radius $R_A$ may define a constant value, and the central angle $\alpha_A$ may subtend an arc having a first end 53 and a second end 55. The central angle $\alpha_A$ may be between ten degrees and one hundred degrees, such that the pumping portion $\mathbf{48}_A$ of the tubular surface 48 defines a portion of a circle extending about the central axis A1.

With reference to FIGS. 7B and 7C, the first working zone B may be defined by a first working portion $48_B$ of the tubular surface 48. As illustrated in FIG. 3, the first working portion $48_B$ of the tubular surface 48 may define a central angle $\alpha_B$ and a radius $R_B$ relative to the central axis A1 of the chamber 46. In some implementations, the radius $R_B$ may define a non-constant (e.g., increasing and/or decreasing) value, and the central angle $\alpha_B$ may be between one hundred seventy-five degrees and one hundred thirty degrees, such that the first working portion $48_B$ of the tubular surface 48 defines an oblong (e.g., an oval, an ellipse, and/or an egg-shape) shape about the central axis A1. For example, the radius $R_B$ may decrease in a direction extending about the central axis A1 from the first end 53 of the pumping zone A to the second working zone B.

With reference to FIGS. 7B-7D, the second working zone C may be defined by a second working portion 48*c* of the tubular surface 48. As illustrated in FIG. 3, the second working portion 48*c* of the tubular surface 48 may define a central angle $\alpha_C$ and a radius $R_C$ relative to the central axis A1 of the chamber 46. In some implementations, the radius $R_C$ may define a non-constant (e.g., increasing and/or decreasing) value, and the central angle $\alpha_C$ may be between one hundred seventy-five degrees and one hundred thirty degrees, such that the second working portion 48*c* of the tubular surface 48 defines an oblong (e.g., an oval, an ellipse, and/or an egg-shape) extending about the central axis A1. For example, the radius $R_C$ may decrease in a direction extending about the central axis A1 from the second end 55 of the pumping zone A to the first working zone B. In some implementations, the central angle $\alpha_C$ of the second working zone C may be substantially equal to the central angle $\alpha_B$ of the first working zone B, and the radius $R_C$ of the second working zone C may be substantially equal to the radius $R_B$ of the first working zone B at locations disposed at equal angles about the axis A1 relative to the second and first ends 53, 55, respectively, of the pumping zone A.

The tubular surface 48 may include a first port 54 and a second port 56. The first and second ports 54, 56 may be in fluid communication with the interior chamber 46 such that the first port 54 receives a fluid from a fluid source (e.g., a tank, a reservoir, etc.) and delivers the fluid to the first working zone A of the interior chamber 46, and the second port 56 outputs the fluid from the second working zone B of the interior chamber 46 to a use location (not shown). In some examples, the tubular surface 48 defines a socket 58 between the first port 54 and the second port 56.

Figure 2:
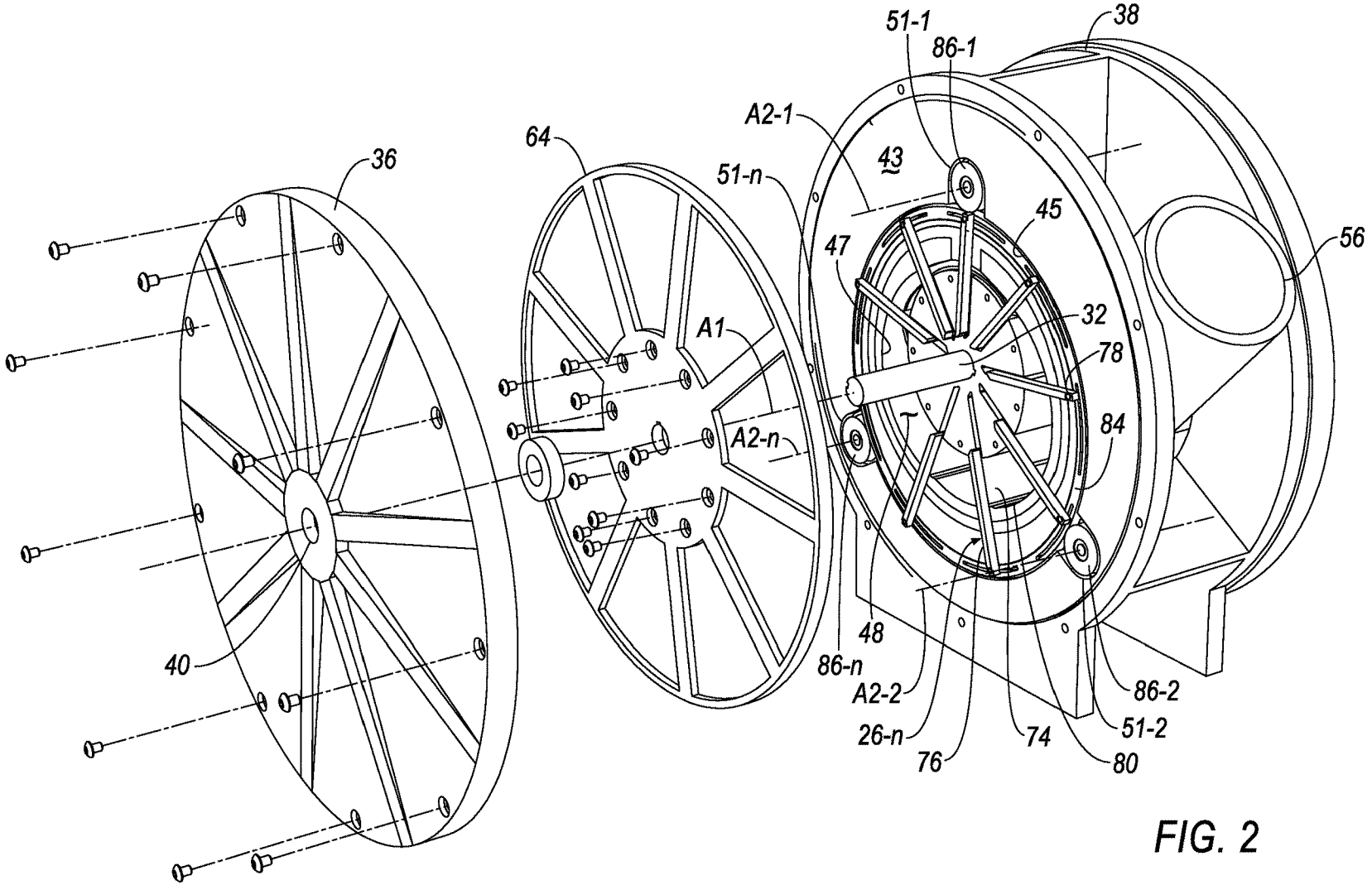
FIG. 2 is a partially exploded perspective view of the rotary device of FIG. 1A.

With reference to at least FIGS. 1A and 2, the rotor 24 may include a rotor body (e.g., a hub 62) and a pair of plates 64. The hub 62 may include a cylindrical outer surface 66, a central aperture 68, and a plurality of slots 70-1, 70-2, . . . **70-*n*. The outer surface 66 may extend concentrically about the central aperture 68. The plurality of slots 70-1, 70-2, . . . 70-*n* may be formed within, and equally spaced about, the outer surface 66 and extend radially inwardly relative thereto. In some implementations, the hub 62 may include nine slots 70-1, 70-2, . . . 70-*n*. It will be appreciated, however, that the hub 62 may include any number of slots 70-1, 70-2, . . . 70-*n* within the scope of the present disclosure. As illustrated in FIG. 3, each slot 70-1, 70-2, . . . 70-*n* may extend along (e.g., parallel to) its own respective axis $A_{70}$. In this regard, each slot 70-1, 70-2, . . . 70-*n* may be defined in part by its own respective first guide surface 71 and a second guide surface 73. The first and second guide surfaces 71, 73 of each slot 70-*n* may extend along (e.g., parallel to) the axis $A_{70}$ of the respective slot 70-*n***.

In the assembled configuration, the hub 62 may be disposed within the interior chamber 46 of the housing 22 for rotation about the central axis A1. In this regard, in the assembled configuration, the central axis A1 may be aligned with the central aperture 68 of the hub 62.

The plates 64 may include a plurality of radially extending grooves 72-1, 72-2, . . . **72-*n*. The number and spacing of the grooves 72-1, 72-2, . . . 72-*n* may correspond to the number and spacing of the plurality of slots 70-1, 70-2, . . . 70-*n*. In this regard, in the assembled configuration, the plates 64 may be coupled to opposite ends of the hub 62 such that the grooves 72-1, 72-2, . . . 72-*n* are aligned with the slots 70-1, 70-2, . . . 70-*n* of the hub 62**.

With continued reference to at least FIGS. 1A and 2, each vane assembly **26-*n* may include a plate 74, a pair of arms 76, a pair of pins 78, and a wiper 80. The number of vane assemblies 26-1, 26-2, . . . 26-*n* may correspond to the number of slots 70-1, 70-2, . . . 70-*n* and the number of grooves 72-1, 72-2, . . . 72-*n*. In this regard, as will be explained in more detail below, in the assembled configuration, each vane assembly 26-*n* may be translatably disposed within a respective one of the slots 70-*n* and one of the respective grooves 72-*n*. For example, each arm 76 may be translatably (e.g., radially translatable) disposed within a respective groove 72-*n*, and each plate 74 may be translatably (e.g., radially translatable) disposed within a respective slot 70-*n*. The pair of arms 76 may be coupled to opposite ends of the plate 74, and one pin 78 of the pair of pins 78 may be coupled to an end of each arm 76. In this regard, as illustrated in FIG. 1A, the pin 78 may be coupled to, and extend axially from, a radially outer end of each arm 76, and the plate 74 may be coupled to, and extend axially from, a radially inner end of each arm 76. The wiper 80 may be coupled to, and extend axially along, a radially outer end of the plate 74**.

As illustrated in FIGS. 7C and 7D, in some implementations, a radially outer end of each plate 74 (e.g., a radially outer end of each wiper 80) may include a concave surface 82 extending axially along the end of each plate 74. During operation of the rotary device 20, the concave surface 82 may reduce the friction between the plate 74 and the housing body 38 when the radially outer end of each plate 74 engages the tubular surface 48 (e.g., pumping portion $48_A$) of the housing body 38. In this regard, with reference to FIG. 7D, the concave surface 82 and the pumping portion $48_A$ of the tubular surface 48 may define a void 83 extending therebetween. During operation of the rotary device 20, the void 83 may be filled with the pumped fluid (e.g., water, fuel, lubricant, etc.) to cushion the radially outer end of the vane 74 as the radially outer end engages the pumping portion $48_A$ of the tubular surface 48. For example, the pumped fluid within the void 83 may produce a radially inwardly extending biasing force on the concave surface 82, thus improving the radially extending tolerance of the vane 74 relative to the hub 62 and the chamber 38.

With reference to FIGS. 1A-4 and 11, the coupler 28 may include a pair of bearing rings 84 and a plurality of bearings 86-1, 86-2, . . . **86-*n*. In some implementations, the coupler 28 may include six bearings 86-*n*. It will be appreciated, however, that the bearing assembly may include more than six bearings 86-*n*** within the scope of the present disclosure.

Figure 1B:
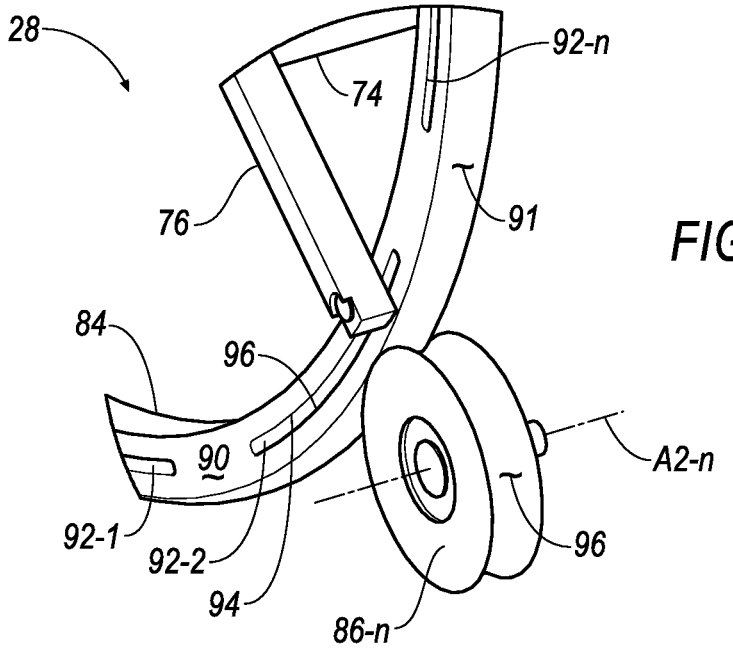
FIG. 1B is an enlarged view of a portion of a guide ring and a bearing assembly of the rotary device of FIG. 1A referenced from line 1B of FIG. 1A.

Each bearing ring 84 may define a circular shape having a radially-extending surface 90 and a bearing-receiving surface 91. The radially-extending surface 90 may include a plurality of slots 92-1, 92-2, . . . **92-*n* formed therein. The number and spacing of the slots 92-1, 92-2, . . . 92-*n* may correspond to the number and spacing of the slots 70-1, 70-2, . . . 70-*n* formed in the plates 64, and the number and spacing of the grooves 72-1, 72-2, . . . 72-*n* formed in the hub 62. As illustrated in FIG. 1B, the slots 92-*n* may each be defined by an arcuate inner surface 94 and an arcuate outer surface 96 opposing the arcuate inner surface 94. In some implementations, the inner surface 94 of the slots 92-1, 92-2, . . . 92-*n* collectively define a first path P1, and the outer surface 96 of the slots 92-1, 92-2, . . . 92-*n* collectively define a second path P2. The first path P1 may be concentric to the second path P2. In some implementations, the first and/or second paths P1, P2 define a circular shape. As illustrated in FIG. 3, the first and/or second path P1, P2 may define an angle β relative to the axis $A_{70}$, and/or relative to the first and second guide surfaces 71, 73, of each slot 70-1, 70-2, . . . 70-*n*. As will be explained in more detail below, during operation of the rotary device 20, the angle β associated with each slot 70-1, 70-2, . . . 70-*n* may vary such that the angle $\beta_1$, $\beta_2$, . . . $\beta_n$ associated with each slot 70-1, 70-2, . . . 70-*n* may, at any given instant of time, be different than the instantaneous angle β associated with one or more each of the other slots 70-1, 70-2, . . . 70-*n***.

As will be explained in more detail below, in the assembled configuration, the each pin 78 of the vane assemblies **26-*n* may be translatably disposed within one of the slots 92-*n* to couple the vane assemblies 26-*n* to the bearing ring 84**.

Figure 1C:
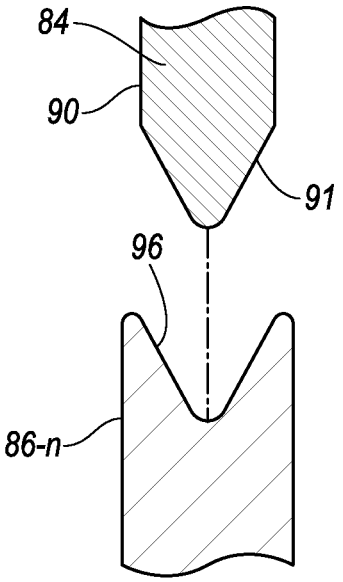
FIG. 1C is a cross-sectional view of a portion of the guide ring and the bearing assembly of FIG. 1B.
Figure 1D:
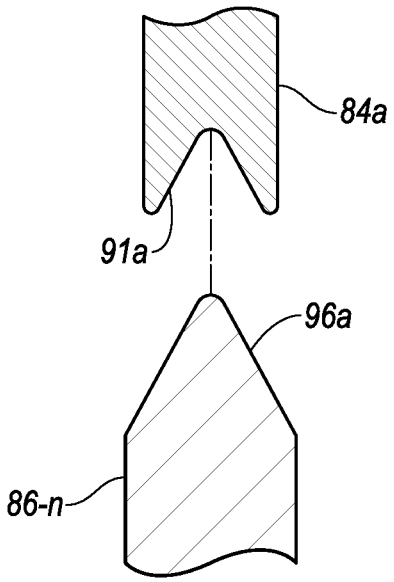
FIG. 1D is a cross-sectional view of a portion of another guide ring and bearing assembly.

The bearing-receiving surface 91 may extend annularly about the bearing ring 84. As illustrated in FIGS. 1B and 1C, in some implementations, the bearing-receiving surface 91 defines a convex profile (e.g., C-shaped, V-shaped, U-shaped, etc.). As illustrated in FIG. 1D, in other implementations, the bearing ring **84*a* may include a bearing-receiving surface 91*a*** defining a concave profile (e.g., C-shaped, V-shaped, U-shaped, etc.).

The bearings **86-*n* may each define a generally cylindrical construct having a ring-receiving surface 96. The ring-receiving surface 96 may extend annularly about the bearing 86-*n*. The ring-receiving surface 96 may define a shape and/or profile that mates with a corresponding shape and/or profile of the bearing-receiving surface 91 of the ring 84 to couple the bearing ring 84 to the housing body 38. As illustrated in FIGS. 1B and 1C, in some implementations, the ring-receiving surface 96 defines a concave profile (e.g., C-shaped, V-shaped, U-shaped, etc.). As illustrated in FIG. 1D, in other implementations, the bearing 86*a*-*n* may include a ring-receiving surface 96*a*** defining a convex profile (e.g., C-shaped, V-shaped, U-shaped, etc.).

Figure 4:
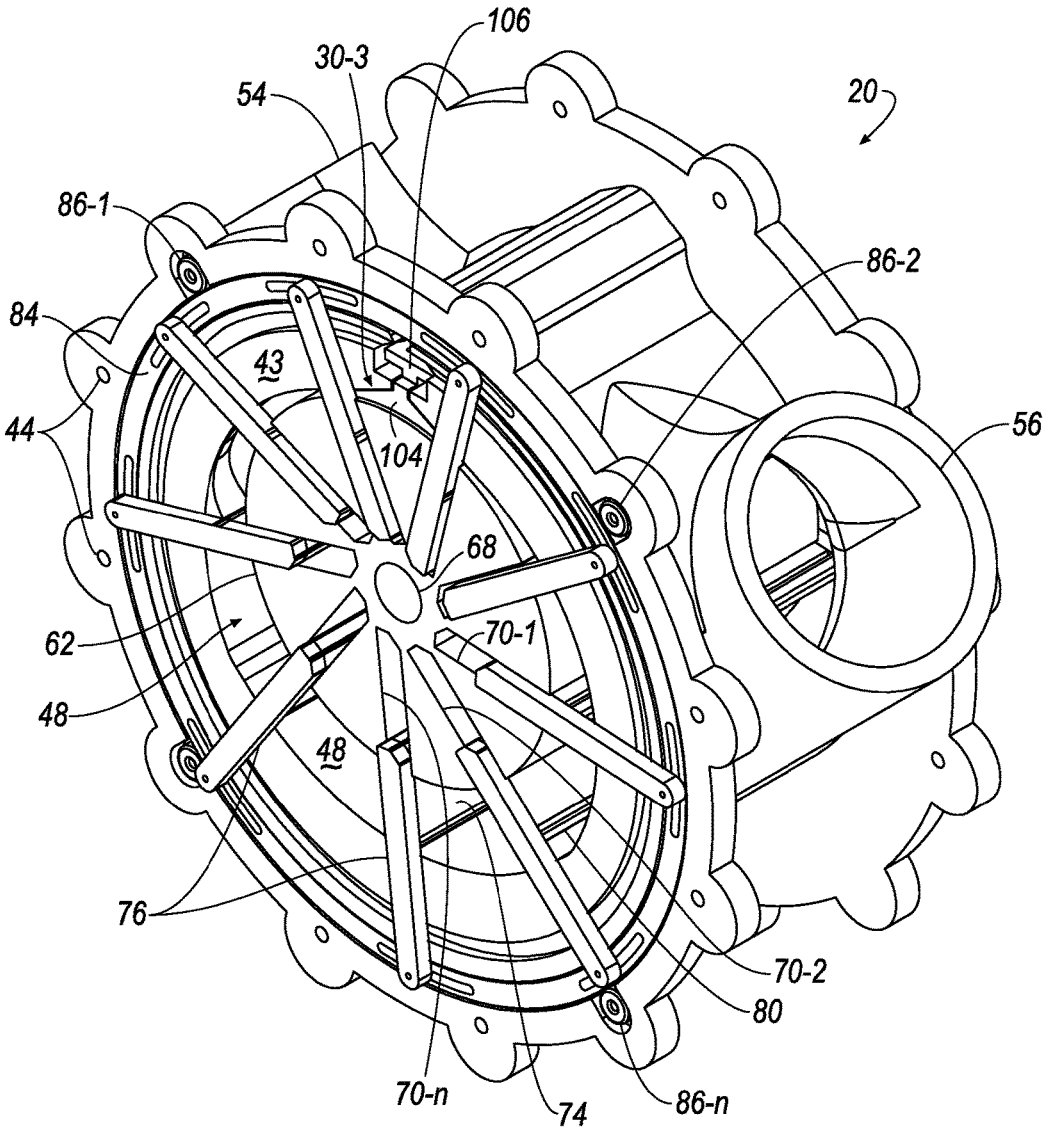
FIG. 4 is a perspective view of the rotary device of FIG. 1A, a portion of the rotary device being removed for clarity.
Figure 5:
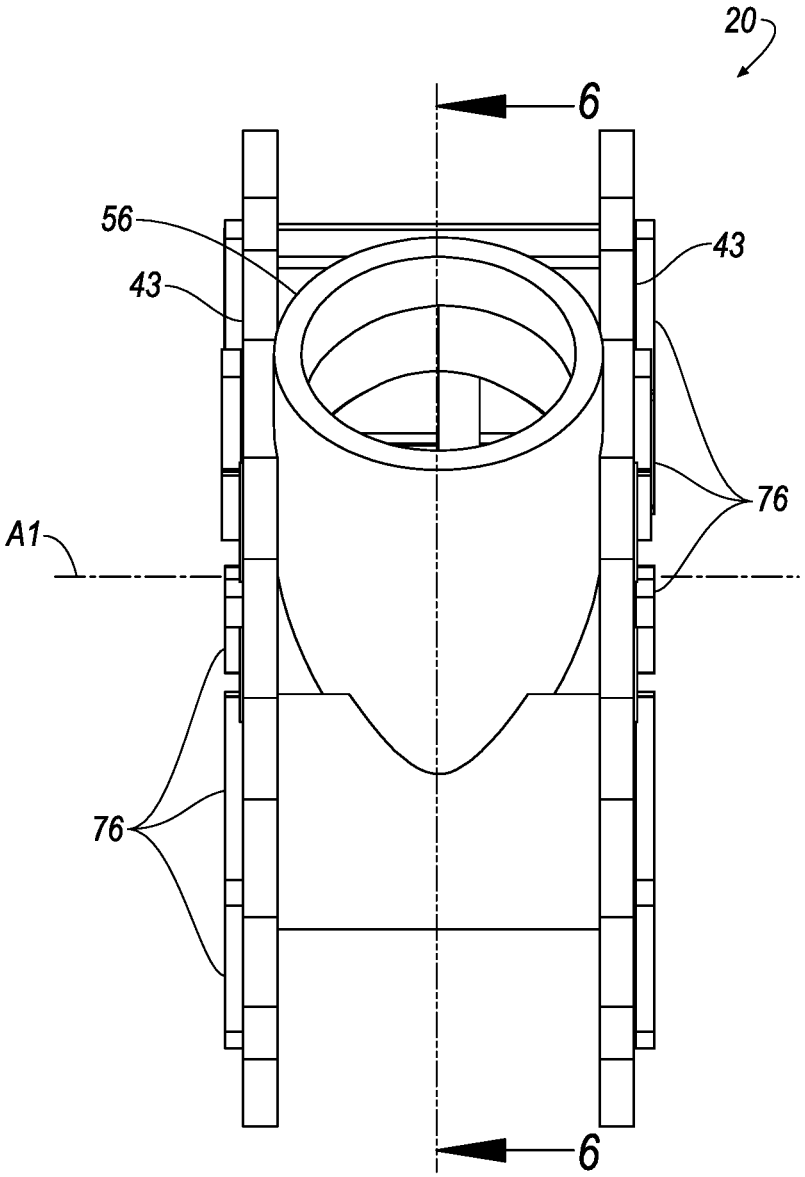
FIG. 5 is an end view of the rotary device of FIG. 1A, a portion of the rotary device being removed for clarity.
Figure 6:
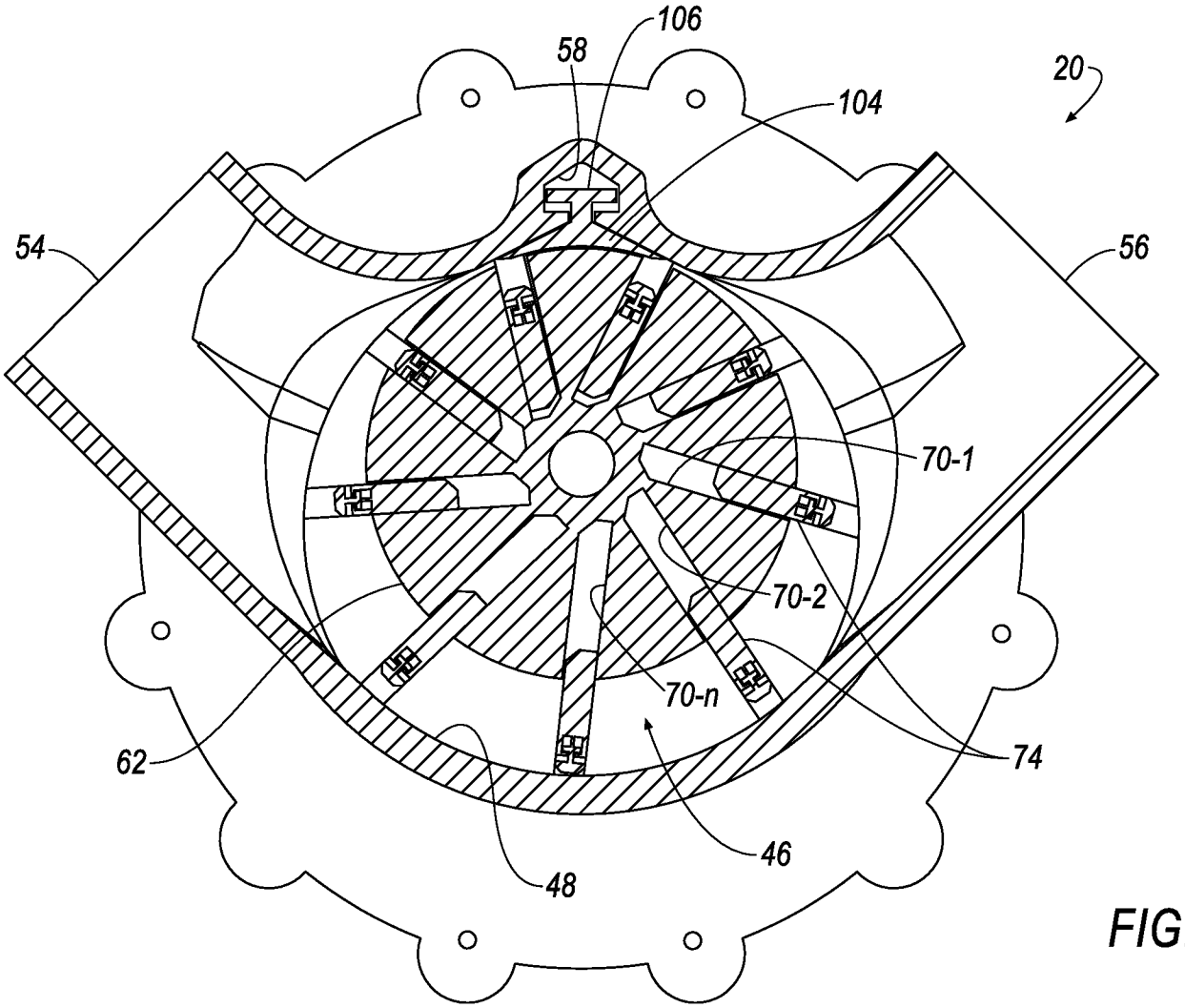
FIG. 6 is a cross-sectional view of the rotary device of FIG. 1A taken along the line A-A of FIG. 5.

In the assembled configuration, the bearings **86-*n* may be rotatably coupled to the housing body 38 for rotation about respective axes A2-1, A2-2, . . . A2-*n*, and the bearing ring 84 may be rotatably coupled to the housing body 38 for rotation about an axis A3. With reference to FIGS. 2 and 3, the axes A2-*n*, A3 may extend in a direction substantially parallel to the axis A1. In some implementations, the bearings 86-*n* and the bearing ring 84 are rotatably disposed within the channel 45. In particular, the bearing ring 84 may be disposed within the channel 45 such that the bearing-receiving surface 91 is concentrically disposed about the tubular surface 48 of the housing body 38. Each bearing 86-1, 86-2, . . . 86-*n* may be disposed within one of the lobes 51-1, 51-2, . . . 51-*n* such that the ring-receiving surfaces 96 engages the bearing-receiving surface 91 of the bearing ring 84. In this regard, the bearings 86-1, 86-2, . . . 86-*n* may be concentrically disposed about the axis A3. As illustrated in FIGS. 2, 4, and 5, in the assembled configuration, the arms 76 may axially protrude from the surface 43 and be translatably disposed within the grooves 72-*n* of the plates 64**, as previously described.

With reference to FIG. 1A, the plurality of seals 30-1, 30-2, . . . **30-*n* may include a pair of side seals 30-1, a driveshaft seal 30-2, and a chamber seal 30-3. The plurality of seals 30-1, 30-2, . . . 30-*n* may permit fluid to flow into and out of the pump 20 substantially only via the first 54 and second 56 ports. In this regard, the side seals 30-1 and the driveshaft seal 30-2 may define a generally ring-shaped construct. In the assembled configuration, the side seals 30-1 may be disposed within the channel 45. For example, each side seal 30-1 may be disposed between, and engage, the bearing ring 84 and the housing body 38, such that the side seals 30-1 prevent fluid communication between the chamber 48 and the channel 45. The driveshaft seal 30-2 may be disposed about the driveshaft 32 to prevent fluid communication between the chamber 48 and the aperture 40 of the end plates 36**.

The chamber seal 30-3 may include a body portion 104 and a fin 106. The body portion 104 may include an inner sealing surface 108 and an outer sealing surface 110 opposite the inner sealing surface 108. The inner and outer sealing surfaces 108, 110 may define an arcuate shape. For example, the inner sealing surface 108 may be generally concave, while the outer sealing surface 110 may be generally convex. In the assembled configuration, the chamber seal 30-3 may be at least partially disposed within the chamber 46 of the housing 38. In particular, the body portion 104 may be disposed within the chamber 46 such that the outer sealing surface 110 sealingly engages the tubular surface 48, and the inner sealing surface 108 sealingly engages the vane assembly **26-*n* (e.g., the wiper 80). The fin 106 may be translatably disposed within the socket 58 of the housing body 38. In this regard, the chamber seal 30-3 may be translatable (e.g., radially translatable) relative to the housing body 38 to allow fluid communication between the first port 54 and the second port 56 in one of a clockwise flow direction and a counterclockwise flow direction, and prevent fluid communication between the first port 54 and the second port 56** in the other of the clockwise flow direction and the counterclockwise flow direction.

With reference to FIGS. 2 and 3, and as previously described, in the assembled configuration, the plates 64 and the hub 62 (only one plate is shown in FIG. 2 and no plates are shown in FIG. 3) may be disposed within the housing body 38 for rotation about the axis A1, while the bearing ring 84 and the bearings 86-1, 86-2, . . . 86-3 may be concentrically disposed about the axis A3. The driveshaft 32 may be disposed within the aperture 40 of at least one of the end plates 36 and coupled to the rotor 24 within the aperture 68 for rotation therewith. The vanes assemblies 26-1, 26-2, . . . **26-*n* may be coupled to the rotor 24 and the coupler 28. For example, the plate 74 of each vane assembly 26-*n* may be translatably disposed in one of the slots 70-*n* of the hub 62, while each arm 76 of each vane assembly 26-*n* may be translatably disposed within one of the grooves 72-*n* of the plates 64, and each pin 78 may be translatably disposed within one of the slots 92-1, 92-2, . . . 92-*n* of the bearing ring 84**.

During operation of the pump 20, rotation of the driveshaft 32 may rotate the rotor 24 within the chamber 46 about the axis A1. As the rotor 24 rotates within the chamber 48, the plate 74 of each vane assembly **26-*n* may translate radially inwardly and radially outwardly within one of the slots 70-*n* of the hub 62, while each arm 76 of each vane assembly 26**-*n* may translate radially inwardly and radially outwardly within one of the grooves 72-*n* of the plates 64. In this regard, the plates (or vanes) 74 may engage the first and/or second guide surfaces 71, 73 during translation inwardly and outwardly within the slots 70-*n* of the hub 62, such that the plates 74 translate along a respective axis $A_{70}$.

With reference to FIGS. 7C and 7D, translation of the plates 74 within the slots 70-*n* of the hub 62 will now be described. As illustrated in FIG. 7C, during operation, each plate 74 may enter the pumping zone A proximate the end 55 prior to an adjacent plate 74 exiting the pumping zone A proximate the end 53. Each plate 74 may translate within a respective slot 70-*n* to engage the pumping portion $\mathbf{48}_A$ of the tubular surface 48 upon entering the pumping zone A proximate the end 55. The translational velocity of each plate 74 within the respective slot 70-*n* may vary based on the angular velocity of the rotor 24 about the axis A1, such that the torque transmitted by each plate 74 to the rotor 62 (e.g., to the guide surface 71) varies as the rotor 62 rotates about the axis A1. As illustrated in FIG. 7D, as the rotor 62 continues to rotate about the axis A1, each plate 74 may translate within a respective slot 70-*n* to disengage the pumping portion $\mathbf{48}_A$ of the tubular surface 48 upon exiting the pumping zone A proximate the end 53.

As the rotor 24 rotates within the chamber 48, each pin 78 of each vane assembly 26-*n* may translate within one of the slots 92-1, 92-2, . . . 92-*n* of the bearing ring 84. In this regard, each pin 78 may translate in a first direction (e.g., clockwise) and a second direction (e.g., counterclockwise), opposite the first direction, within one of the slots 92-1, 92-2, . . . 92-*n*. As the pins 78 translate within the slots 92-*n*, the angle β associated with each slot 70-1, 70-2, . . . 70-*n* may vary such that, as illustrated in FIG. 3, a circumferentially-extending distance (e.g., an arc length D) between adjacent vane assemblies 26-1, 26-2, . . . 26-*n* continuously varies during 360° rotation of the pump 20. For example, as illustrated in FIG. 3, a circumferentially-extending distance between adjacent pins 78 in the working zones B, C may be less than a circumferentially-extending distance between adjacent pins 78 in the pumping zone A, such that adjacent pins 78 are closer to one each other in the working zones B, C than in the pumping zone A. Similarly, a circumferentially-extending distance between adjacent plates 74 of each vane assembly 26-1, 26-2, . . . 26-*n* in the working zones B, C may be less than the a circumferentially-extending distance between adjacent plates 74 of each vane assembly 26-1, 26-2, . . . 26-*n* in the pumping zone A, such that adjacent plates 74 are closer to one each other in the working zones B, C than in the pumping zone A.

As the pins 78 translate within one of the slots 92-1, 92-2, . . . 92-*n*, each pin 78 of each vane assembly 26-*n* may intermittently engage the bearing ring 84 (e.g., FIGS. 3 and 11) to cause the bearing ring 84 to rotate about the axis A3. As the bearing ring 84 rotates about the axis A3, engagement between the bearing ring 84 and the bearings 86-1, 86-2, . . . 86-*n* may cause each bearing 86-1, 86-2, . . . 86-*n* to rotate about a respective one of the axes A2-1, A2-2, . . . A2-3.

Figure 8A:
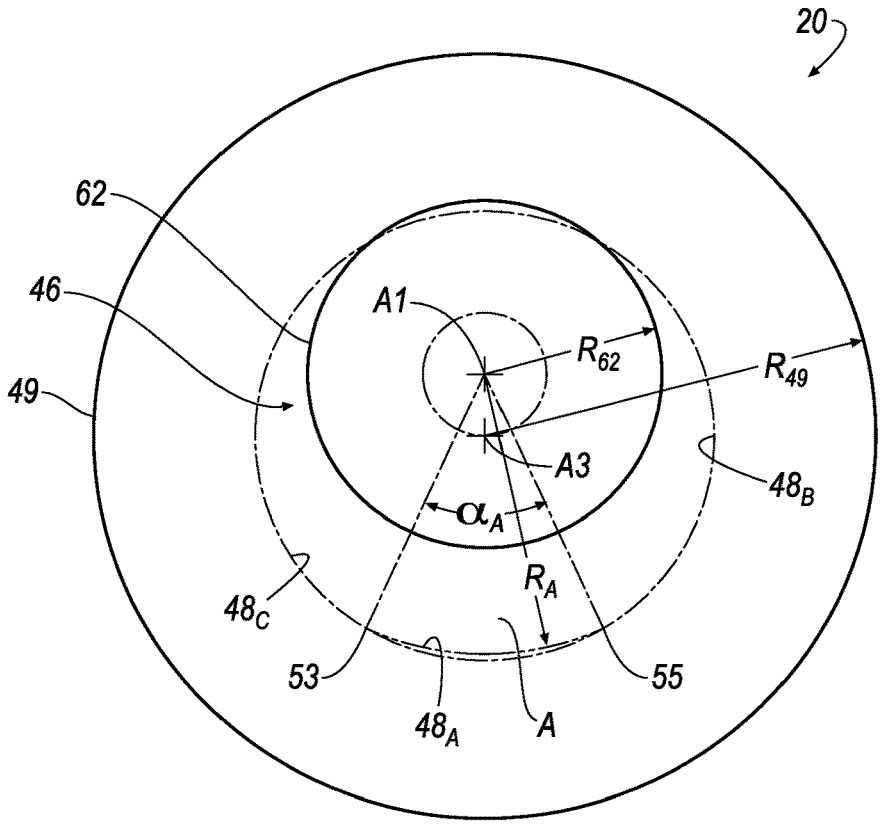
FIG. 8A is a schematic diagram showing geometric relationships amongst components of a rotary device according to the principles of the present disclosure.
Figure 8B:
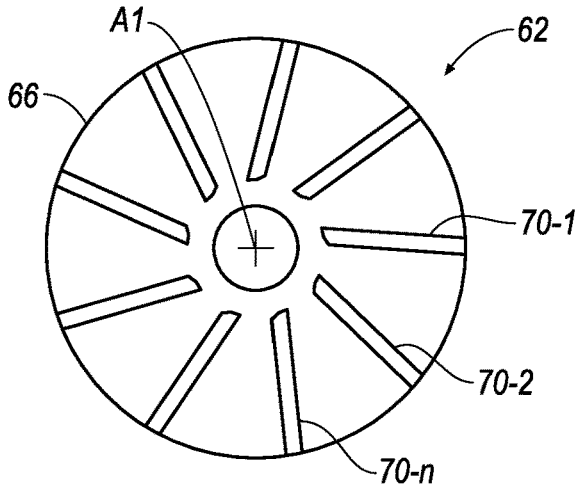
FIG. 8B is a schematic diagram showing geometric relationships amongst components of the rotary device of FIG. 8A.

With reference to FIGS. 8A and 8B, a schematic diagram of a portion of the pump 20 is shown. A ratio of the radius $R_A$ of the pumping portion $\mathbf{48}_A$ of the tubular surface 48 to a radius $R_{62}$ of the rotor 62 may be between 1.30 and 1.50. In some implementations, the ratio of the radius $R_A$ to the radius $R_{62}$ is substantially equal to 1.39. A ratio of the radius $R_A$ of the pumping portion $\mathbf{48}_A$ of the tubular surface 48 to a radius $R_{49}$ of the track 49 may be between 0.70 and 0.80. In some implementations, the ratio of the radius $R_A$ to the radius $R_{49}$ is substantially equal to 0.73. The central angle $\alpha_A$ of the pumping zone A may be substantially equal to fifty degrees. The working zones B, C may define a substantially oblong shape (e.g., oval shape, elliptical shape, egg shape, etc.), while the pumping zone A may define a substantially circular shape. A ratio of the radius $R_A$ to a radially-extending length of the plates 74 of the vane assemblies 26-*n* may be between 2.50 and 2.70. In some implementations, the ratio of the radius $R_A$ to the radially-extending length of the plates 74 of the vane assemblies 26-*n* is substantially equal to 2.63. The geometry of the rotor 62, the chamber 46, the track 49, and the plates 74 allows the plates 74 to completely retract within the slots 70-1, 70-2, . . . 70-*n* of the rotor 62 as the rotor rotates about the axis A1.

Figure 9A:
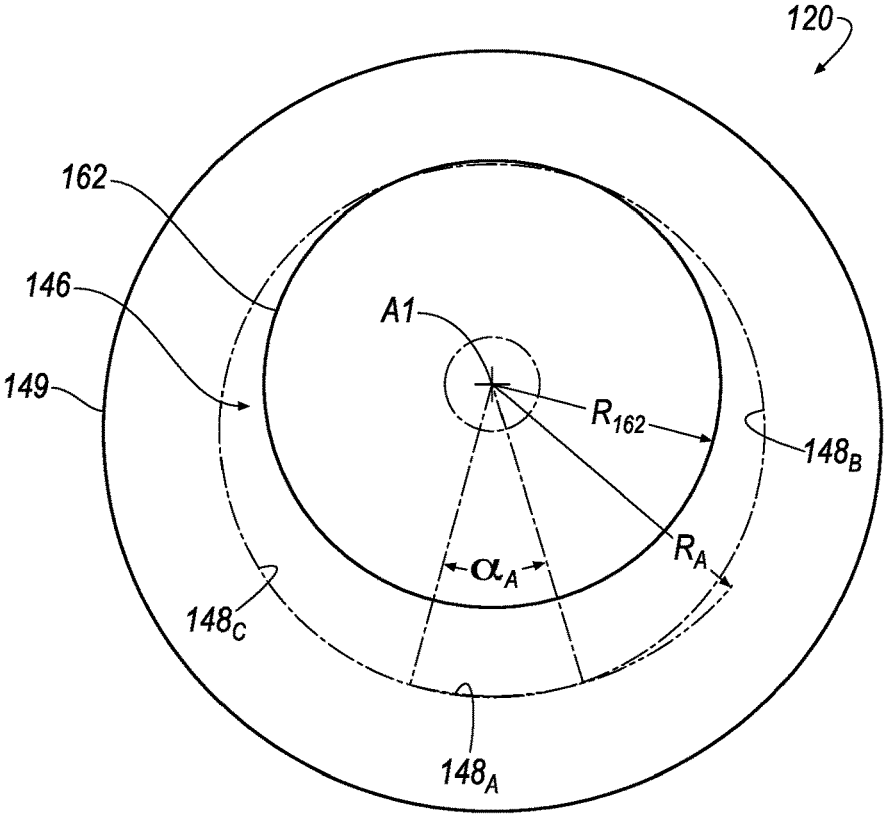
FIG. 9A is a schematic diagram showing geometric relationships amongst components of a rotary device according to the principles of the present disclosure.
Figure 9B:
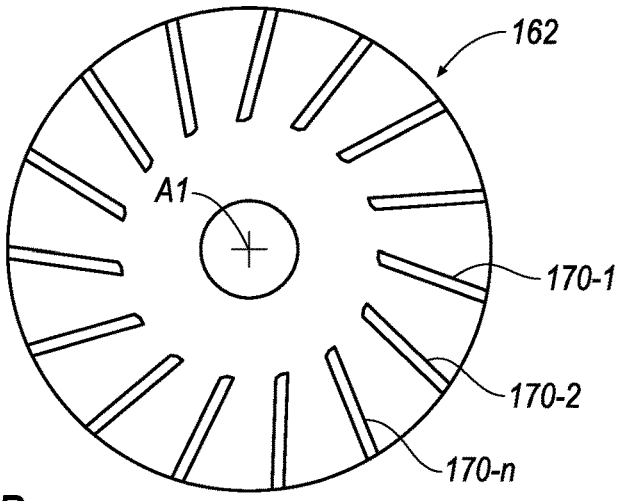
FIG. 9B is a schematic diagram showing geometric relationships amongst components of the rotary device of FIG. 9A.

With reference to FIGS. 9A and 9B, a schematic diagram of a portion of another pump 120 is shown. The structure and function of the pump 120 may be substantially similar to that of the pump 20, apart from any exceptions described below and/or shown in the Figures. Accordingly, the structure and/or function of similar features will not be described again in detail. The pump 120 may include a rotor 162 that is substantially similar to the rotor 62 except as otherwise shown or described herein. The rotor 162 may include fifteen slots 170-1, 170-2, . . . 170-*n* that are equally spaced about the axis A1 of the rotor 162. The slots 170-1, 170-2, . . . 170-*n* may be substantially similar to the slots 70-1, 70-2, . . . 70-*n* except as otherwise shown or described herein. In an assembled configuration, the rotor 162 may be disposed within a chamber 146 of a housing (not shown) defining a track 149. The chamber 146 and the track 149 may be substantially similar to the chamber 46 and track 49 except as otherwise shown or described herein.

A ratio of the radius $R_A$ of the pumping portion $\mathbf{148}_A$ of the tubular surface 148 to a radius $R_{162}$ of the rotor 162 may be between 1.30 and 1.50. In some implementations, the ratio of the radius $R_A$ to the radius $R_{162}$ is substantially equal to 1.39. A ratio of the radius $R_A$ of the pumping portion $\mathbf{148}_A$ of the tubular surface 148 to a radius $R_{149}$ of the track 149 may be between 0.80 and 0.90. In some implementations, the ratio of the radius $R_A$ to the radius $R_{149}$ is substantially equal to 0.818. The central angle $\alpha_A$ of the pumping zone A may be substantially equal to thirty-two degrees. The working zones B, C may define a substantially oblong shape (e.g., oval shape, elliptical shape, egg shape, etc.), while the pumping zone A may define a substantially circular shape. A ratio of the radius $R_A$ to a radially-extending length of the plates 74 of the vane assemblies 26-*n* may be between 3.50 and 3.60. In some implementations, the ratio of the radius $R_A$ to the radially-extending length of the plates 74 of the vane assemblies 26-*n* is substantially equal to 3.549. The geometry of the rotor 162, the chamber 146, the track 149, and the plates 74 allows the plates 74 to completely retract within the slots 170-1, 170-2, . . . 170-*n* of the rotor 162 as the rotor rotates about the axis A1.

Figure 10A:
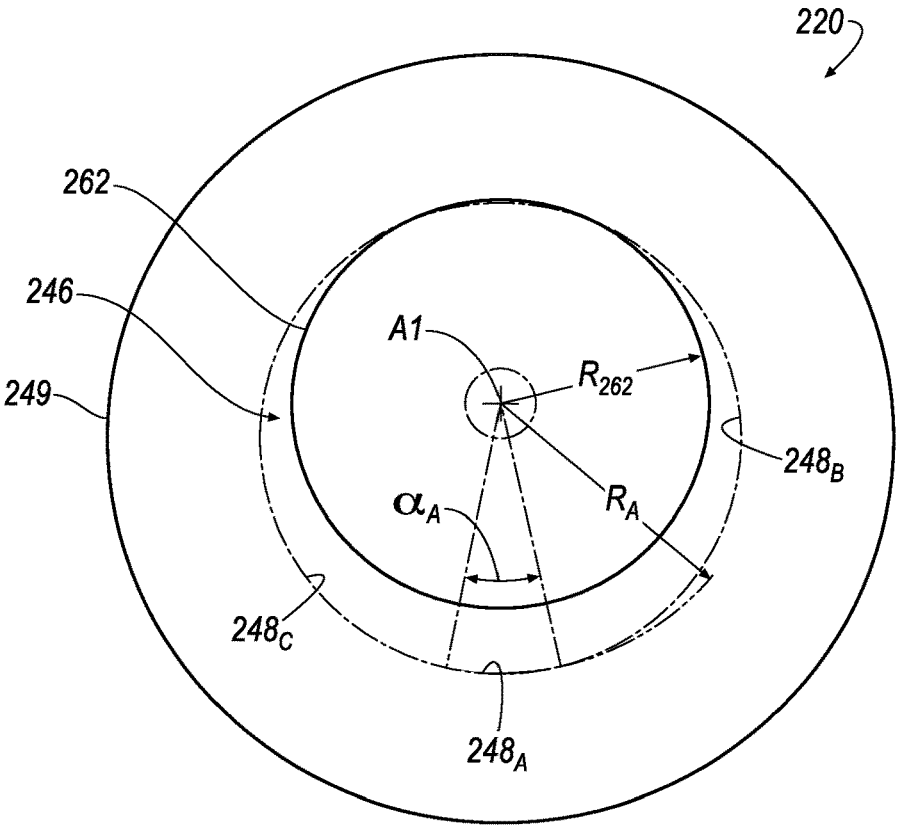
FIG. 10A is a schematic diagram showing geometric relationships amongst components of a rotary device according to the principles of the present disclosure.
Figure 10B:
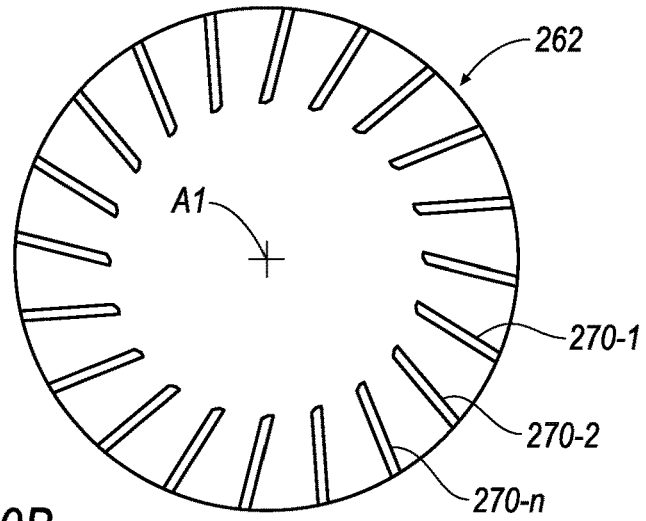
FIG. 10B is a schematic diagram showing geometric relationships amongst components of the rotary device of FIG. 10A.
Figure 11:
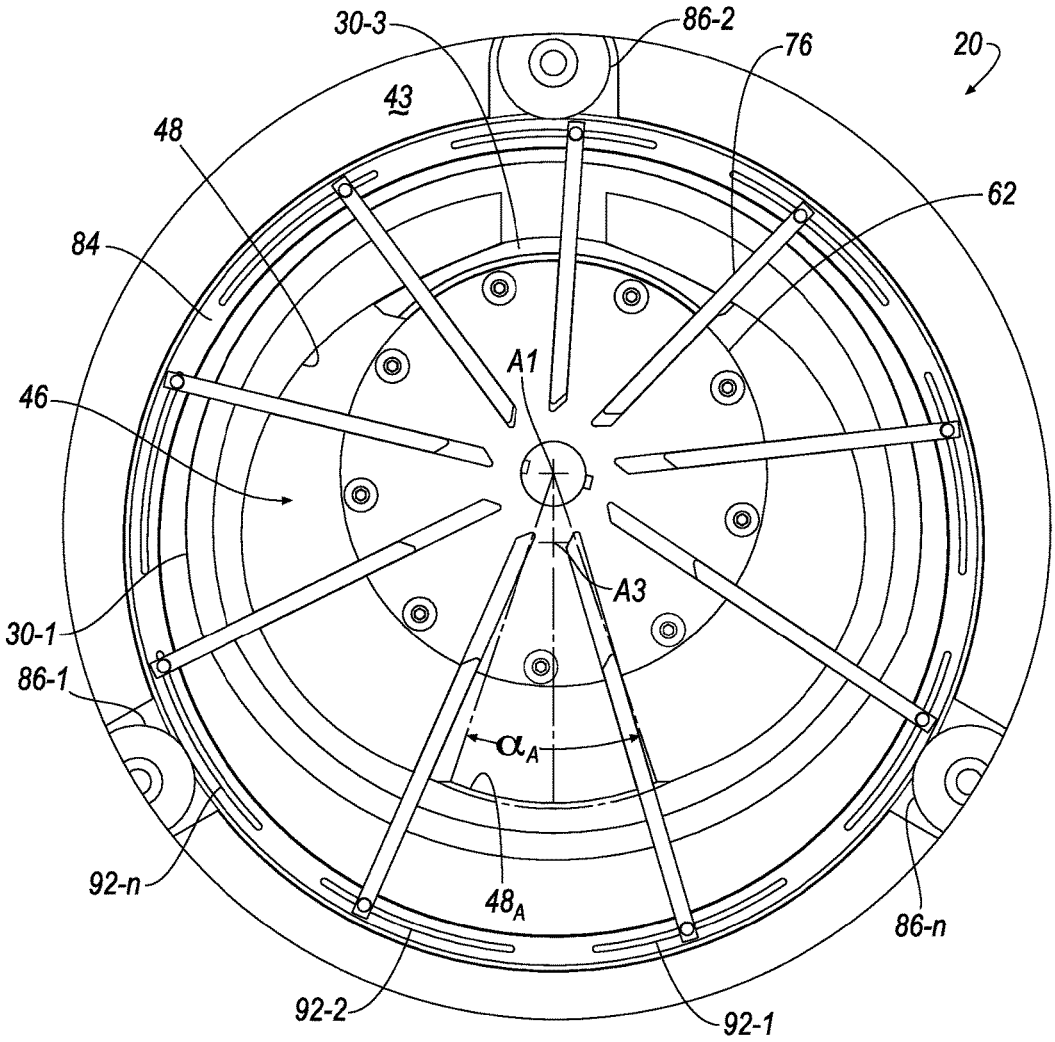
FIG. 11 is a side view of a rotary device according to the principles of the present disclosure, a portion of the rotary device being removed for clarity.

With reference to FIGS. 10A and 10B, a schematic diagram of a portion of another pump 220 is shown. The structure and function of the pump 220 may be substantially similar to that of the pump 20, apart from any exceptions described below and/or shown in the Figures. Accordingly, the structure and/or function of similar features will not be described again in detail. The pump 220 may include a rotor 262 that is substantially similar to the rotor 62 except as otherwise shown or described herein. The rotor 162 may include twenty slots 270-1, 270-2, . . . 270-*n* that are equally spaced about the axis A1 of the rotor 262. The slots 270-1, 270-2, . . . 270-*n* may be substantially similar to the slots 70-1, 70-2, . . . 70-*n* except as otherwise shown or described herein. In an assembled configuration, the rotor 262 may be disposed within a chamber 246 of a housing (not shown) defining a track 249. The chamber 246 and the track 249 may be substantially similar to the chamber 46 and track 49 except as otherwise shown or described herein.

A ratio of the radius $R_A$ of the pumping portion $\mathbf{248}_A$ of the tubular surface 248 to a radius $R_{262}$ of the rotor 262 may be between 1.30 and 1.50. In some implementations, the ratio of the radius $R_A$ to the radius $R_{262}$ is substantially equal to 1.33. A ratio of the radius $R_A$ of the pumping portion $\mathbf{248}_A$ of the tubular surface 248 to a radius $R_{249}$ of the track 249 may be between 0.70 and 0.80. In some implementations, the ratio of the radius $R_A$ to the radius $R_{249}$ is substantially equal to 0.708. The central angle $\alpha_A$ of the pumping zone A may be substantially equal to twenty-four degrees. The working zones B, C may define a substantially oblong shape (e.g., oval shape, elliptical shape, egg shape, etc.), while the pumping zone A may define a substantially circular shape. A ratio of the radius $R_A$ to a radially-extending length of the plates 74 of the vane assemblies **26-*n* may be between 3.90 and 4.10. In some implementations, the ratio of the radius $R_A$ to the radially-extending length of the plates 74 of the vane assemblies 26-*n* is substantially equal to 4.01. The geometry of the rotor 262, the chamber 246, the track 249, and the plates 74 allows the plates 74 to completely retract within the slots 270-1, 270-2, . . . 270-*n* of the rotor 262 as the rotor rotates about the axis A1**.

The configuration of the pumps 20, 120, 220 shown and described herein helps to ensure that the loads borne by the vane assemblies 26-1, 26-2, . . . **26-*n* and the bearing assembly 28 are such that wear occurs relatively slowly and mechanical efficiency of the pump 20, 120, 220 is increased. The wipers 80 sweep the tubular surface 48 largely only in the pumping area $\mathbf{48}_A$ and are otherwise spaced apart therefrom. As a result, wear occurs relatively slowly and mechanical efficiency is increased. The retraction of the vanes well in advance of the chamber seal 30-3, and extension of the vanes well following the chamber seal 30-3 helps to ensure less flow disruption as the fluid is pumped from the working zone B to the pumping zone A, and from the pumping zone A to the working zone C. A gap between each wiper 80 and the tubular surface 48** (*i*) opens relatively quickly after the wiper 90 passes the pumping zone A, (ii) disappears relatively shortly before the wiper 80 reaches the pumping zone A, and grows relatively large outside the pumping zone A, with commensurate impacts on flow dynamics and efficiency. The volume of the pumping chambers (the spaces defined between the rotor 62 and the tubular surface 48, and between adjacent pairs of vanes disposed in the pumping zone A) does not change, which facilitates sharing of loads amongst the vanes.

A number of implementations have been described. Nevertheless, it will be understood that various modifications may be made without departing from the spirit and scope of the disclosure. Accordingly, other implementations are within the scope of the following claims.

What is claimed is:

1. A rotary device for use with a fluid, the rotary device comprising:

a housing having a tubular surface defining, in part, a tubular volume, the housing segregated into at least a pumping zone positioned between first and second working zones, the first working zone configured to receive a fluid and the second working zone configured to output the fluid;

a rotor mounted for rotation about a rotation axis, the rotor having a body mounted within the tubular volume and having a plurality of slots;

a ring at least indirectly coupled to the housing by way of a bearing; and at least one vane associated with one slot of said plurality of slots, said at least one vane connected at least indirectly to the ring and configured to rotate within the tubular volume, wherein the tubular volume defines in cross-section an ovular shape along the first and second working zones and a circular shape along the pumping zone.

2. The rotary device of claim 1, wherein the bearing is coupled to the housing and positioned to support the ring, the bearing configured to rotate about a bearing axis and maintain a position of the ring with respect to the housing as the ring rotates.

3. The rotary device of claim 2, wherein the ring includes an outer surface in contact with an outer surface of the bearing.

4. The rotary device of claim 3, wherein the outer surface of the ring has a concave shape and the outer surface of the bearing has a convex shape complimentary to the concave shape of the ring.

5. The rotary device of claim 3, wherein the outer surface of the ring has a convex shape and the outer surface of the bearing has a concave shape complimentary to the convex shape of the ring.

6. The rotary device of claim 1, further comprising a track disposed outside the tubular volume, the track disposed concentrically about at least a portion of the tubular surface.

7. The rotary device of claim 6, wherein the ring is sized to fit within the track.

8. The rotary device of claim 6, wherein the track defines a circular shape.

9. The rotary device of claim 1, wherein the tubular volume defines in cross-section a circular shape along the pumping zone and the first and second working zones.

10. The rotary device of claim 1, wherein the ring includes a plurality of slots, and wherein each vane is configured to move within a slot of the plurality of slots.

11. The rotary device of claim 10, wherein each slot is separated from an adjacent slot by a distance.

12. The rotary device of claim 1, wherein the rotary device is one of a pump and a hydraulic motor.

13. The rotary device of claim 1, wherein each vane includes an end configured to engage the tubular surface, the end defining a concave surface.

* * * * *